US006601354B2

(12) United States Patent
Hughes

(10) Patent No.: US 6,601,354 B2
(45) Date of Patent: Aug. 5, 2003

(54) METHOD AND APPARATUS FOR POST-TENSIONING STEEL STRANDS IN SLAB CONSTRUCTION

(76) Inventor: Bill Hughes, 2476 N. Lake Ave., Altadena, CA (US) 91001

( * ) Notice: Subject to any disclaimer, the term of this patent is extended or adjusted under 35 U.S.C. 154(b) by 0 days.

(21) Appl. No.: 09/905,503

(22) Filed: Jul. 12, 2001

(65) Prior Publication Data

US 2003/0009962 A1 Jan. 16, 2003

(51) Int. Cl.[7] ..... E04C 5/08

(52) U.S. Cl. ..... 52/223.6; 52/223.13; 52/223.14; 52/576

(58) Field of Search ..... 52/223.14, 223.13, 52/223.6, DIG. 1, 127.5, 249, 576

(56) References Cited

U.S. PATENT DOCUMENTS 3,552,074 A * 1/1971 Rajchman ..... 52/223
3,673,644 A * 7/1972 Howlett et al. ..... 24/122.6
3,676,968 A * 7/1972 Campbell ..... 52/223 R
3,935,685 A * 2/1976 Howlett ..... 52/223 L
4,348,844 A * 9/1982 Schupack et al. ..... 52/230
4,621,943 A * 11/1986 Swanson ..... 404/70
4,671,034 A * 6/1987 Rehm et al. ..... 52/223 L
4,928,451 A * 5/1990 Reigstad et al. ..... 52/223 L
5,113,634 A * 5/1992 Luthi ..... 52/741
5,386,675 A * 2/1995 Baur et al. ..... 52/250
5,459,973 A * 10/1995 Baumann ..... 52/726.1
6,082,063 A * 7/2000 Shrive et al. ..... 52/223.13
6,327,825 B1 * 12/2001 Sanders et al. ..... 52/167.1

* cited by examiner

*Primary Examiner*—Anita King
*Assistant Examiner*—Steven Marsh
(74) *Attorney, Agent, or Firm*—James E. Brunton

(57) ABSTRACT

A method and apparatus for post-tensioning a reinforcing strand disposed within a concrete slab of the character having a plurality of reinforcing members embedded therein. The apparatus includes a yieldably deformable elastomeric body having a longitudinally extending passageway formed therein for receiving the reinforcing strand. The apparatus also includes a removal mechanism for use in expeditiously removing the elastomeric body from the concrete slab after the slab has been poured.

15 Claims, 5 Drawing Sheets

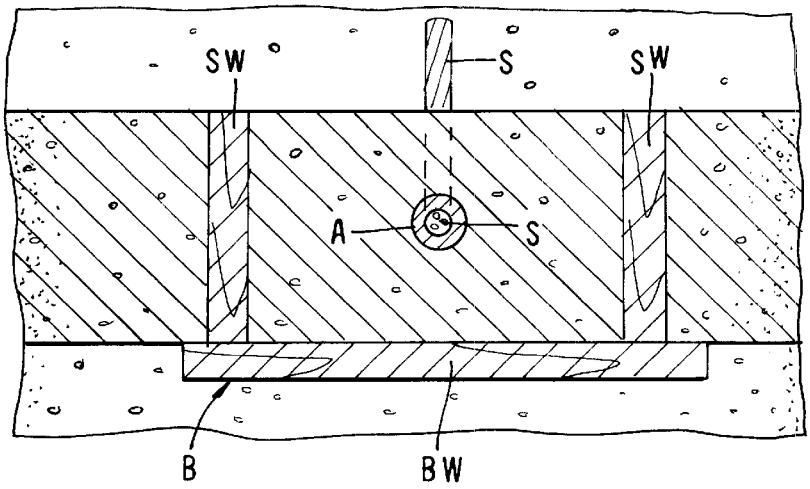
FIG. 3
PRIOR ART
FIG. 4
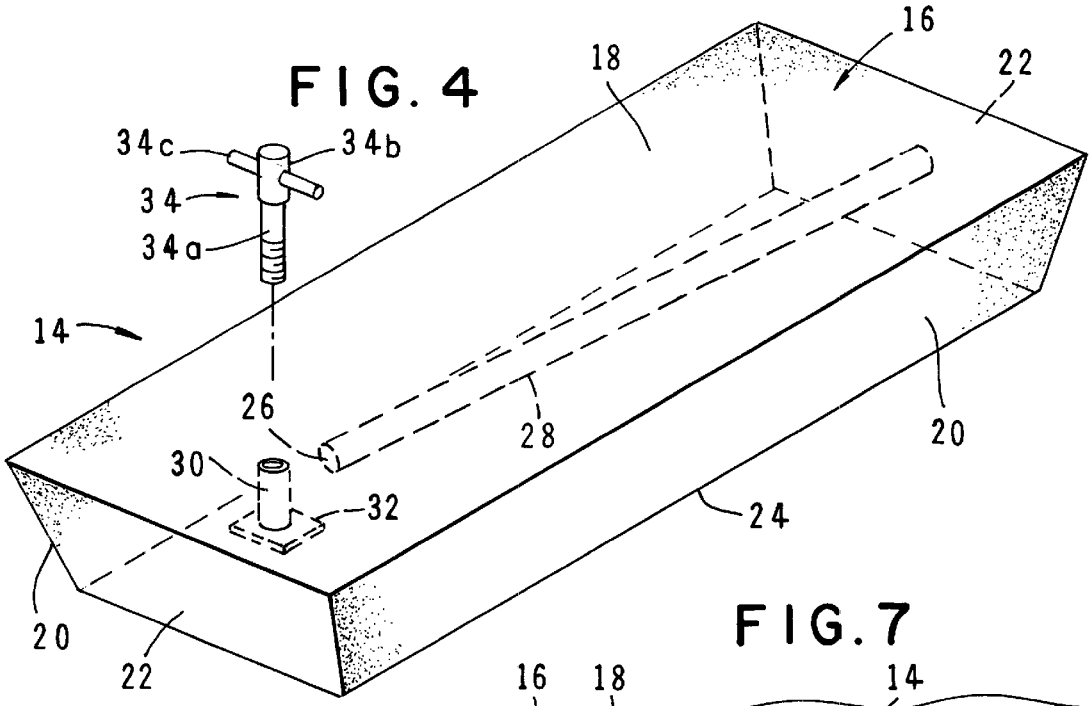
FIG. 7
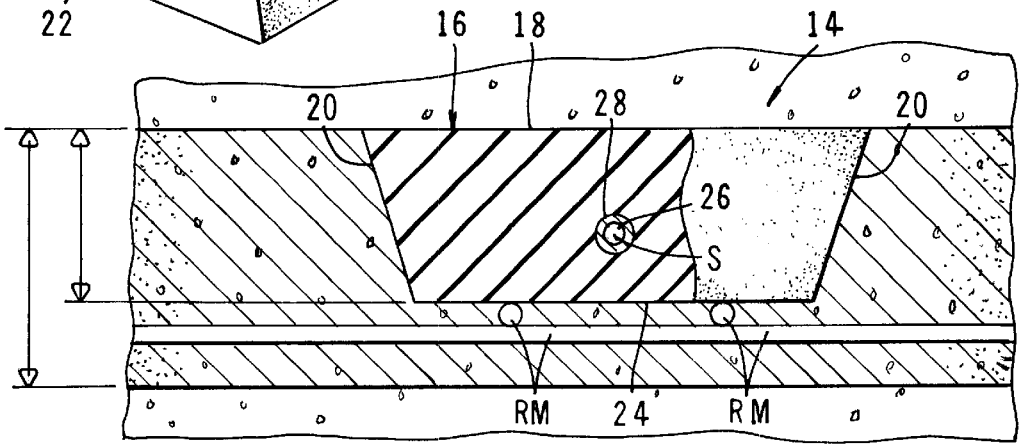

METHOD AND APPARATUS FOR POST-TENSIONING STEEL STRANDS IN SLAB CONSTRUCTION

BACKGROUND OF THE INVENTION

1. Field of the Invention

The present invention relates generally to building construction. More particularly, the invention concerns a method and apparatus for post tensioning steel strands in reinforced concrete slabs.

2. Discussion of the Prior Art

In accordance with standard prior art construction techniques concrete floor slabs are typically reinforced with high strength steel strands to increase the load carrying capacity of floor slabs. Post-tensioning of these strands is also a routine engineering procedure, when the steel strands penetrate the edge of the slab and are anchored therein using a standard anchoring device.

In those instances when a post-tensioned slab design is used in conjunction with a typical prior art precast hybrid moment resistant frame that is also serving as the architectural facade of the building, it is not possible for the strand to penetrate the edge of the slab due to the architectural nature of the beam face. In this case, to still gain the advantage of the strand post-tensioning, the strand must be accessed from the top of the slab at a location far enough away from the interior beam face so as to allow for the positioning of appropriate strand stressing equipment such as a stressing jack.

In the past when a strand terminated at a point other than a slab edge, a wood frame blockout was typically constructed so that the strand could be accessed at the top of the slab. These wood frame blockouts, which are constructed prior to pouring the slab, are both labor-intensive, time-consuming and expensive to construct. Additionally, following the post-tensioning step, the relatively large cavity formed by the frame blockout had to be filled with concrete, generally by hand. This required the time consuming step of constructing and installing a bottom form and then filling the rather large cavity with concrete. It is these prior art construction problems that the method and apparatus of the present invention seeks to alleviate. As will be better understood from the description that follows, one approach to the solution to the aforementioned problems is to provide an elastomeric slab blockout assembly of unique design that is easy to install and remove and, after being removed from the poured slab, leaves a relatively small cavity that can be quickly and easily filled.

In one form of the invention the novel blockout assembly is constructed so as to have a relatively small overall height that allows it to be supported by the underlying slab reinforcement steel bars in a manner such that the top of the block out assembly is flush with the top of the slab. By not having the block out extend completely through the slab, the fill-in operation can be performed without having to construct and install a bottom form. Additionally, because the top surface of the removable blackout assembly is flush with the top of the slab elevation, the concrete finishing equipment can freely pass over the block out without interference. This eliminates the "rolling" of the slab edge which inevitably occurs at an edge form of conventional construction.

The elastomeric blockout assembly of the invention is preferably configured to form a cavity having a length and a width that will readily accommodate the throw of the stressing jack. Because, in the preferred form of the invention the body of the blockout assembly is constructed from an elastomeric material, it can be easily flexed to expedite its easy removal from the poured slab. Additionally, the elastomeric material chosen is preferably of character that allows for easy cleaning to permit multiple re-use of the blockout assembly.

SUMMARY OF THE INVENTION

It is an object of the present invention to provide a method and apparatus for use in post-tensioning a reinforcing strand disposed within a concrete slab of the character having a plurality of reinforcing members embedded therein. More particularly, it is an object of the invention to provide an apparatus of the character described that includes a yieldably deformable elastomeric body having a top wall, a bottom wall and side walls interconnecting the top and bottom walls, the elastomeric body having a longitudinally extending passageway formed therein for receiving the reinforcing strand.

Another object of the invention is to provide an apparatus as described in the preceding paragraph in which the elastomeric body has a thickness less than the thickness of the concrete slab so that the elastomeric body can rest on the reinforcing members with the top thereof substantially flush with the top of the concrete slab.

Another object of the invention is to provide removal means for expeditiously removing the elastomeric body from the concrete slab after the slab has been poured.

Another object of the invention is to provide an apparatus as described in the preceding paragraph in which the elastomeric body is readily deformable so that, by pulling upwardly on the removal means, the body can be deformed in a manner to easily separate it from the poured concrete slab.

Another object of the invention is to provide an apparatus of the character described that is constructed of a material that is readily cleanable so that the blocking assembly can be reused a significant number of times.

Another object of the invention is to provide an apparatus of the class described herein which is easy to use, is inexpensive to manufacture and, after being removed from the poured slab, leaves a relatively small cavity that needs to be filled with concrete.

These and other objects of the invention are achieved by the method and apparatus described in the paragraphs that follow.

DESCRIPTION OF THE DRAWINGS

FIG. 3 is a cross-sectional view taken along lines 3—3 of FIG. 2.

FIG. 4 is a generally perspective, exploded view of one form of the blockout assembly of the present invention for use in forming a cavity within the concrete slab to enable post-stressing of the steel strands embedded therewithin.

FIG. 7 is a cross-sectional view taken along lines 7—7 of FIG. 6.

DESCRIPTION OF THE INVENTION

Figure 1:
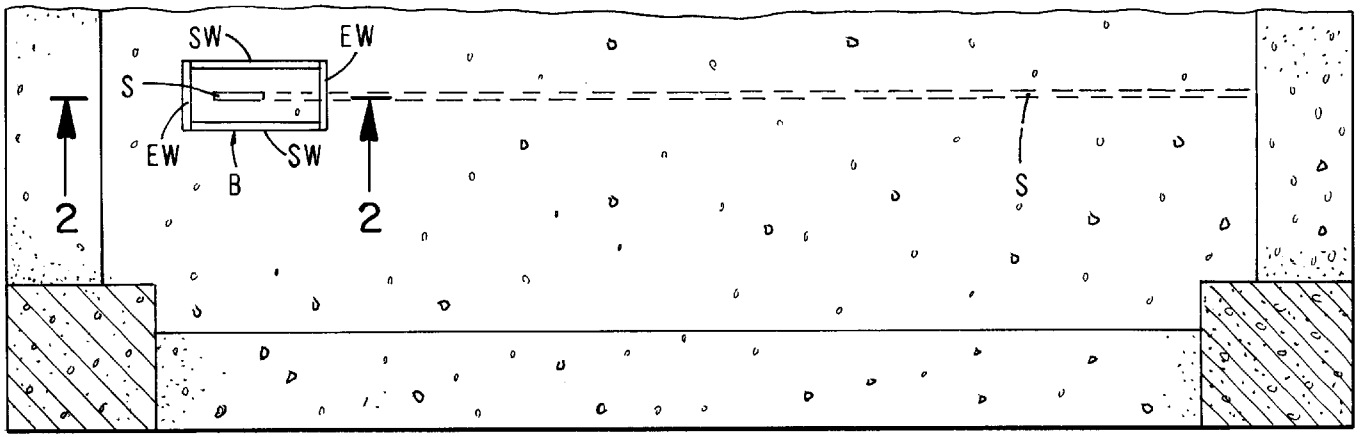
FIG. 1 PRIOR ART
FIG. 1 is a top plan view illustrating the conventional prior art technique for post-tensioning strands in concrete floor slabs when it is not possible for the reinforcing strand to penetrate the edge of the slab due to the architectural nature of the beam face.
Figure 2:
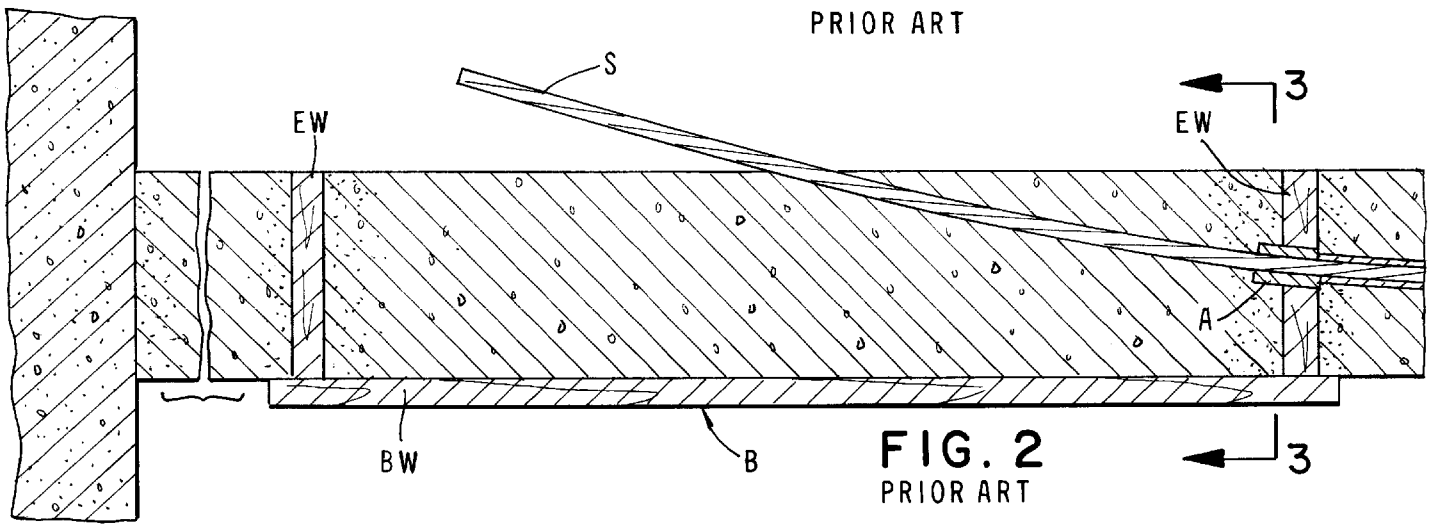
FIG. 2 PRIOR ART
FIG. 2 is a greatly enlarged, cross-sectional view taken along lines 2—2 of FIG. 1.

Referring to the drawings and particularly to FIGS. 1 and 2, a typical prior art precast, hybrid, moment-resistance, frame construction is there shown. The construction shown in the drawings includes an architectural facade that makes it impossible for the reinforcing strands embedded within the concrete slab to penetrate the edge of the slab. In this type of construction, to gain the advantage of post tensioning of the steel strands, the strands must be accessed from the top of the slab at a location spaced apart from the interior of the beam face. In such a construction, wood frame blockouts generally designated in the drawings by the letter "B" are constructed so as to enable access to a steel strand such as that designated by the letter "S". As indicated in FIGS. 1 and 2, the wood frame blockout "B" comprises a pair of transversely spaced-apart side walls "SW", a pair of longitudinally spaced apart walls "EW" and a bottom wall "BW" (FIG. 2). The wood frame blockouts are, of course, constructed prior to pouring the concrete slab and function to define a cavity through which the strand can be extended and post-tensioned by appropriate post tensioning means such as a stressing jack (not shown). Following the post tensioning of the strand and its anchoring within the slab by an appropriate anchor member "A" (FIG. 2), the cavity defined by the wood frame lockout is filled with concrete in the manner shown in FIG. 2 (see also FIG. 3).

Turning now to FIG. 4, of the drawings, one form of the apparatus of the present invention for use in tensioning a reinforcing strand disposed within a concrete slab is there shown and generally designated by the number 14. The apparatus here comprises a yieldably deformable elastomeric body 16 that is formed from a suitable elastomer such as natural or synthetic rubber. Elastomeric body 16 includes a top wall 18, inwardly sloping side walls 20, inwardly sloping end walls 22 and a bottom wall 24 interconnecting the side and end walls. As indicated in FIG. 7, elastomeric body 16 is of a thickness less than the thickness of the concrete slab to be poured so that the elastomeric body can rest on the steel reinforcing members "RM" that are positioned interiorly of the concrete slab.

Figure 5:
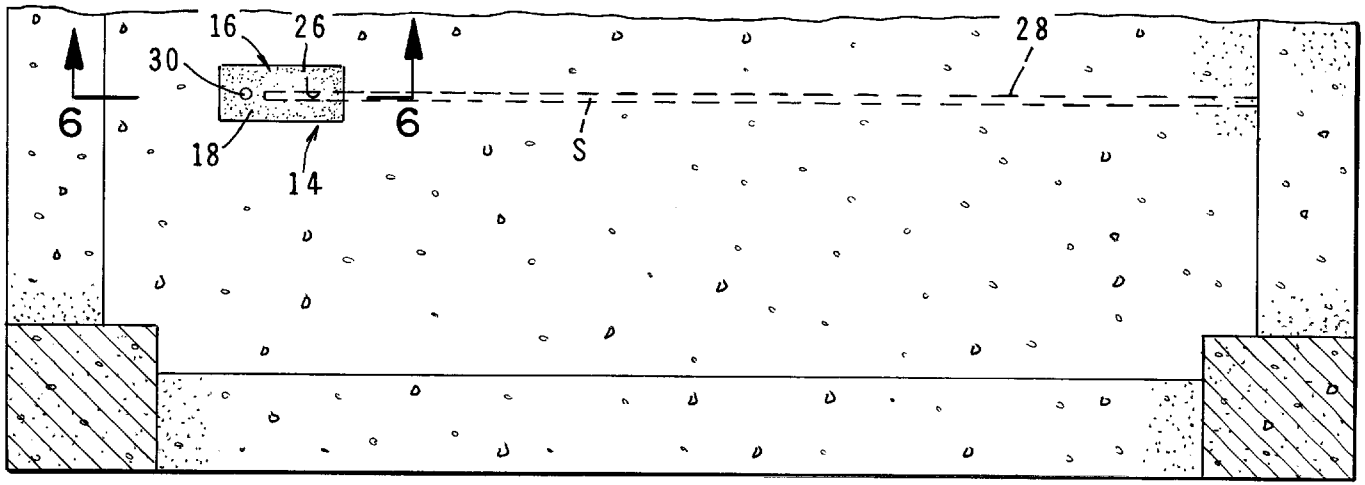
FIG. 5 is a top plan view showing one form of the blockout assembly of the invention positioned within the concrete slab.
Figure 6:
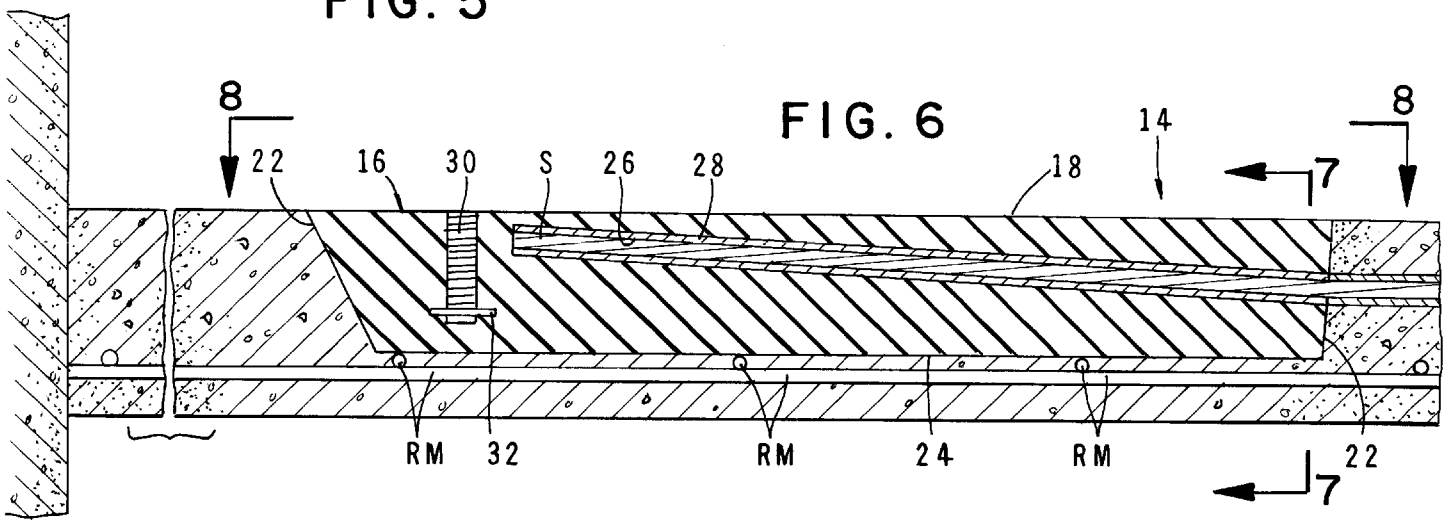
FIG. 6 is a greatly enlarged, cross-sectional view taken along lines 6—6 of FIG. 5.
Figure 8:
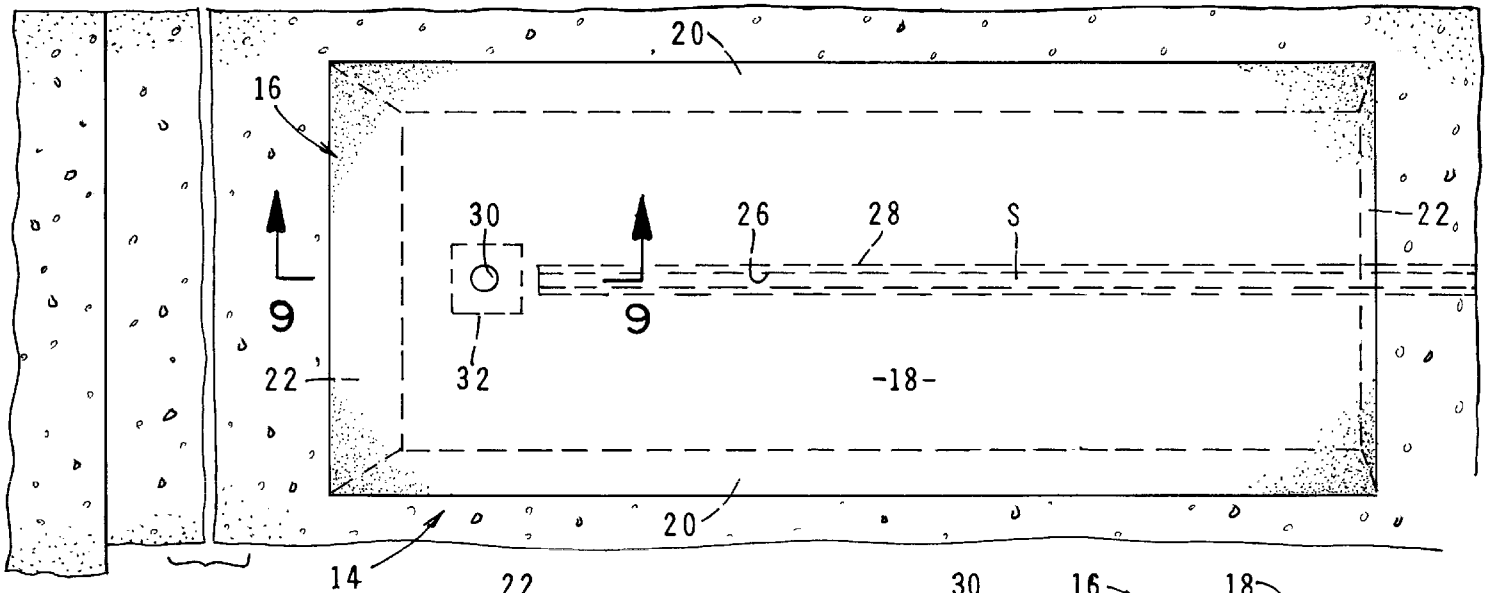
FIG. 8 is a view taken along lines 8—8 of FIG. 6.
Figure 9:
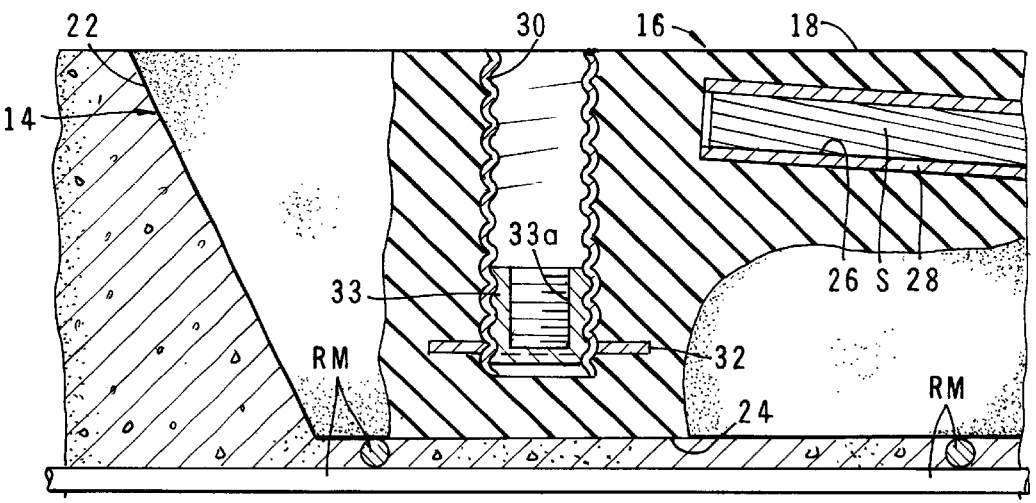
FIG. 9 is a greatly enlarged, cross-sectional view taken along lines 9—9 of FIG. 8 illustrating a portion of the removal means of the invention for removing the blockout assembly from the poured concrete slab.

As indicated by the phantom lines in FIG. 4, elastomeric body 16, which here comprises a part of the blockout assembly of the invention, includes a longitudinally extending passageway 26 that is formed by a longitudinally extending, tubular sleeve 28 (FIG. 7). As best seen in FIGS. 5 and 9, passageway 26 is of a size to closely receive the reinforcing steel strand "S".

Forming an important aspect of the apparatus of the present invention is removal means which is operably associated with the elastomeric body 16 for removing the elastomeric body from the concrete slab after the slab has been poured. In the present form of the invention, the removal means comprises a generally vertically extending, corrugated sleeve 30 that is disposed within elastomeric body 16. Sleeve 30 is anchored within the elastomeric body by an anchor plate 32 (FIG. 4). Disposed within sleeve 30 is a base member 33 having a threaded bore 33*a* (FIG. 9).

Figure 10:
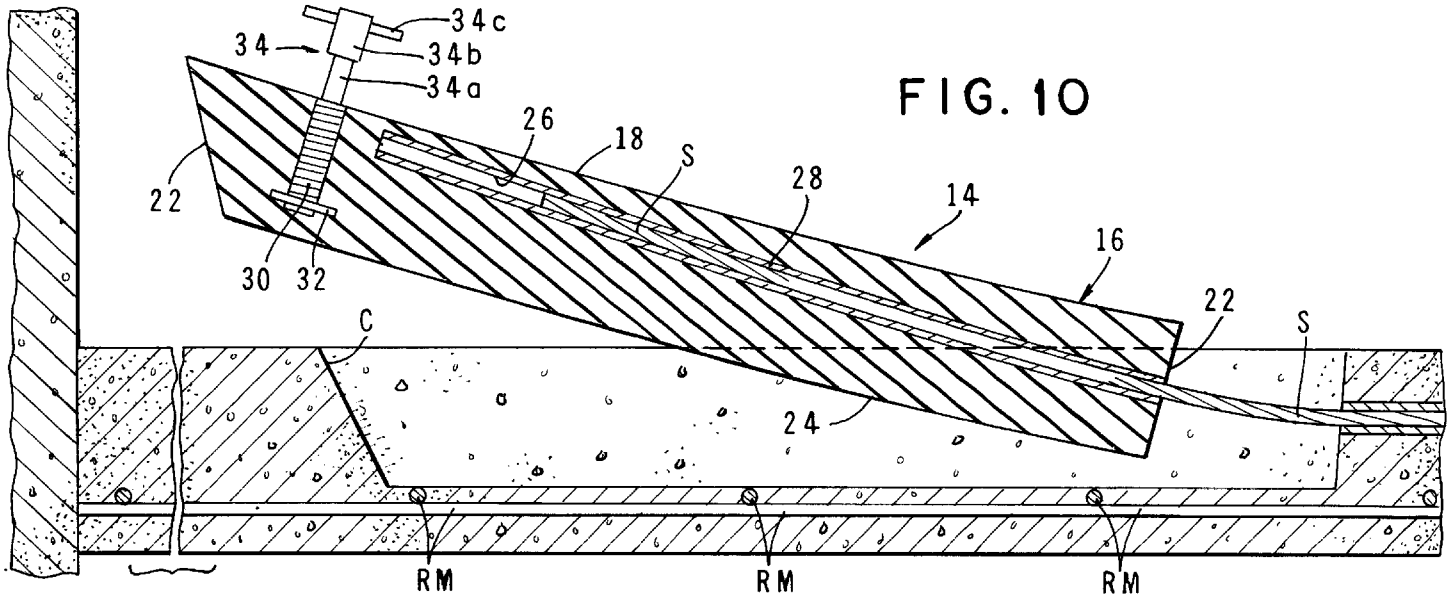
FIG. 10 is a cross-sectional, diagrammatic view illustrating the manner of removal of the blockout assembly from the poured concrete slab.

The removal means of the present form of the invention also includes a gripping member 34 that can be threadably interconnected with base member 33 in the manner shown in FIG. 10. As best seen in FIG. 4, gripping member 34 comprises threaded shank member 34*a* that is threadably interconnectable with base member 33, an enlarged diameter head portion 34*b* and a crossbar 34*c* that extends transversely of head portion 34*b*.

Figure 11:
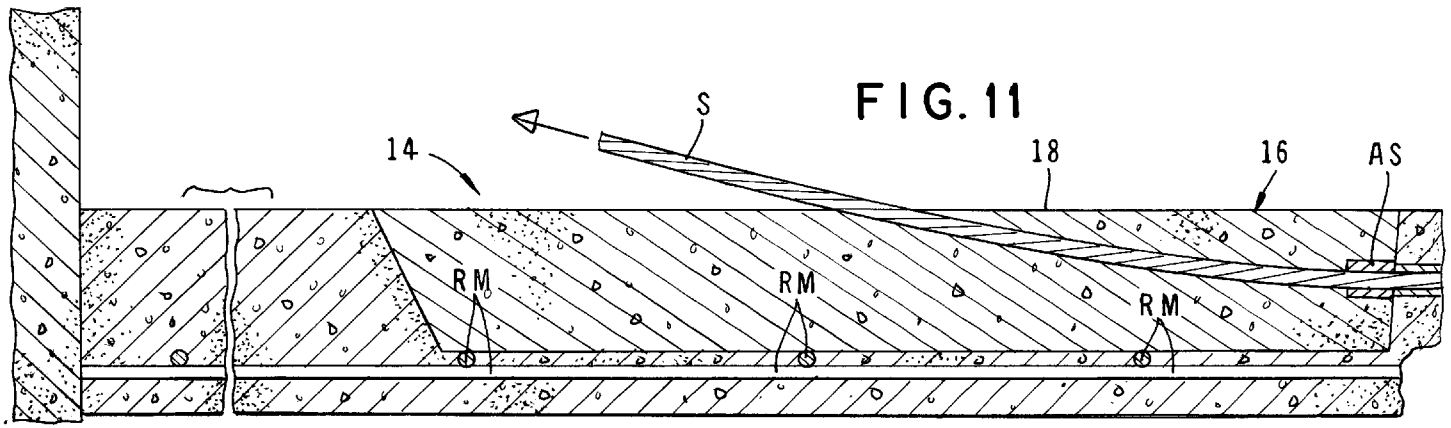
FIG. 11 is a cross-sectional view illustrating the appearance of the concrete slab after the cavity remaining following the removal of the blockout assembly is filled with concrete.

Referring next to FIG. 10, it is to be noted that sleeve 28 extends between the right end wall 22 as viewed in FIG. 10 and a location proximate the top wall 18 of the elastomeric body. With this construction after the slab has been poured, a lifting force exerted on the crossbar 34*c* of the gripping member 34 will enable the elastomeric body to be quickly and easily removed from the poured concrete slab in the manner indicated in FIG. 10 to provide the access cavity "C" for accessing the steel strand. As the elastomeric body is removed from the poured slab, it can be deformed as may be required to expedite its removal. As the elastomeric body is lifted from the concrete slab, the reinforcing strand "S" will slide out of the passageway 26 in the manner indicated so that when the elastomeric body is completely removed from the cavity, the reinforcing strand "S" will protrude from the top of the concrete slab in the manner indicated in FIG. 11. With the strand thusly protruding from the slab, the end of the strand can be interconnected with a suitable post-tensioning device such as a stressing jack (not shown). Following stressing of the strand "S" a suitable anchoring sleeve "AS" can be used to retain the strand in a stressed configuration. After the strand "S" has been post-tensioned in a manner well understood by those skilled in the art, the cavity left in the slab by the removal of the elastomeric block out assembly can be quickly and easily filled with concrete to form the construction shown in FIG. 11.

In carrying out the method of the invention, when the reinforcing members that are to be embedded within the concrete slab that is to be poured are in place and when the steel strands that are to be post-tensioned have been laid over the reinforcing members, the accomplishment of the method of the invention can be undertaken. The first step of one form of the method is to insert the free end portion of a selected one of the reinforcing strands into the longitudinally extending passageway 26 formed in the elastomeric body. This done, the elastomeric body with the reinforcing strand in place within the passageway 26, is laid on top of the reinforcing members and is positioned so that the top of the elastomeric body is flush with the top of the slab that is to be poured. With the apparatus of the invention thusly positioned within the structure, the concrete slab can be poured in the manner such that the concrete flows around and about the elastomeric body.

After the concrete has set up, the removal means of the invention and more particularly, the gripping assembly 34 of the apparatus can be interconnected with the base member 33 of the removal means by threadably interconnecting the threaded shank portion 34*a* of the gripping means with the internally threaded bore 33*a* formed in the base member 33. With the gripping means thusly secured to the base member 33, an upward force exerted on the gripping member in the manner illustrated in FIG. 10 will cause the elastomeric body to deform sufficiently to permit its ready removal from the poured slab in the manner shown in FIG. 10. As the elastomeric body is removed from the slab, the steel strand "S" will, of course, remain in position within the cavity "C" where it can be readily accessed for post-tensioning. Post-tension is, of course, accomplished by gripping the free end of the steel strand with an appropriate post-stressing mechanism such as a stressing jack. Once the strand is suitably stressed, the anchor "AS" which has been previously positioned over the strand will function to maintain stress within the strand in a manner well understood by those skilled in the art. Following post-tensioning of the strand, the cavity "C", which was formed upon removal of the apparatus of the invention from the poured slab, can be readily filled with concrete to form the construction shown in FIG. 11 of the drawings.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for use in tensioning a reinforcing strand disposed within a concrete slab having a plurality of reinforcing members embedded therein, said slab having a thickness and said apparatus comprising:

(a) an elastomeric body having a top wall, a bottom wall and sidewalls interconnecting said top and bottom walls, said elastomeric body having a longitudinally extending passageway formed therein for receiving the reinforcing strand; and (b) removal means operably associated with said elastomeric body for removing said elastomeric body from the concrete slab, said removal means comprising a gripping member connected to said elastomeric body.

2. The apparatus as defined in claim 1 in which said elastomeric body has a thickness less than a thickness of the concrete slab.

3. The apparatus as defined in claim 1 in which said removal means further comprises a generally vertically extending sleeve disposed within said elastomeric body, said gripping member being connected to said sleeve.

4. The apparatus as defined in claim 1 in which said elastomeric body includes an end wall interconnecting said top and bottom walls, said longitudinally extending passageway extending from said end wall to a location proximate said top wall.

5. The apparatus as defined in claim 1 in which said sidewalls of said elastomeric body slope inwardly from said top wall toward said bottom wall.

6. An apparatus for use in tensioning a reinforcing strand disposed within a concrete slab having a plurality of reinforcing members embedded therein, said slab having a thickness and said apparatus comprising:

(a) an elastomeric body having a top wall, a bottom wall and inwardly sloping sidewalls interconnecting said top and bottom walls, said elastomeric body having a thickness less than the thickness of the concrete slab and including a longitudinally extending passageway formed therein for receiving a reinforcing strand; and (b) removal means operably associated with said elastomeric body for removing said elastomeric body from the concrete slab, said removal means comprising a generally vertically extending corrugated sleeve disposed within said elastomeric body and a base member having a threaded bore disposed within said vertically extending corrugated sleeve.

7. The apparatus as defined in claim 6 in which said longitudinally extending passageway is defined by an elongated, generally tubular shaped sleeve.

8. The apparatus as defined in claim 7 in which said elastomeric body includes an end wall interconnecting said top and bottom walls, said generally tubular shaped sleeve extending from said end wall to a location proximate said top wall.

9. The apparatus as defined in claim 8 in which said end wall of said elastomeric body slopes inwardly from said top wall to said bottom wall.

10. An apparatus for use in tensioning a reinforcing strand disposed within a concrete slab having a plurality of reinforcing members embedded therein, said slab having a thickness and said apparatus comprising a blockout assembly for forming a cavity within said slab, said blockout assembly including:

(a) an elastomeric body having a top wall, a bottom wall, an end wall and inwardly sloping sidewalls interconnecting said top, bottom and end walls, said elastomeric body having a thickness less than the thickness of the concrete slab and including a longitudinally extending tubular sleeve having a passageway for receiving the reinforcing strand, said tubular sleeve extending from said end wall to a location proximate said top wall; and (b) removal means operably associated with said elastomeric body for removing said elastomeric body from the concrete slab, said removal means comprising a generally vertically extending corrugated sleeve disposed within said elastomeric body and a base member disposed within said corrugated sleeve, said base member having a threaded bore.

11. The apparatus as defined in claim 10 in which said removal means further includes a gripping member threadably interconnected with said threaded bore of said base member.

12. The apparatus as defined in claim 11 in which said gripping member of said removal means comprises a threaded shank portion threadably receivable within said threaded bore of said base member and a crossbar connected to said threaded shank portion.

13. A method of post tensioning a reinforcing strand that is to be disposed within a poured concrete slab having a plurality of reinforcing members embedded therein, the method being accomplished through the use of an elastomeric body having a longitudinally extending passageway formed therein for receiving the reinforcing strand and removal means comprising a gripping member connected to said elastomeric body for removing the elastomeric body from the poured concrete slab, the method comprising the steps of:

(a) inserting a portion of the reinforcing strand into the longitudinally extending passageway formed in the elastomeric body;

(b) placing the elastomeric body onto the reinforcing members (c) pouring the concrete forming the concrete slab around and about the elastomeric body;

(d) using the removal means, removing the elastomeric body from the poured concrete slab to form a cavity within which a portion of the reinforcing strand resides; and (e) gripping the portion of the reinforcing strand and imparting tensioning stresses to the strand.

14. The method as defined in claim 13 including the further step of, following the post-tensioning of the reinforcing strand, filling with concrete the cavity left in the poured concrete slab by the removal of the elastomeric body.

15. A method of post tensioning a reinforcing strand that is to be disposed within a poured concrete slab having a plurality of reinforcing members embedded therein, the method being accomplished through the use of an elastomeric body having a longitudinally extending passageway formed therein for receiving the reinforcing strand and removal means operably associated with said elastomeric body for removing the elastomeric body from the poured concrete slab, removal means comprising a vertically extending tube disposed within the elastomeric body, a base member disposed with the vertically extending tube and a gripping member interconnectable with the base member, the method comprising the steps of:

(a) inserting a portion of the reinforcing strand into the longitudinally extending passageway formed in the elastomeric body;

(b) placing the elastomeric body onto the reinforcing members;

(c) pouring the concrete forming the concrete slab around and bout the elastomeric body;

(d) following the pouring of the concrete slab, connecting the gripping member to the base member;

(e) exerting an upward force on the gripping member to remove the elastomeric body from the poured concrete slab; and (f) gripping the portion of the reinforcing strand and imparting tensioning stresses to said strands.

* * * * *